US008443919B2

(12) United States Patent
Ramirez Santiago

(10) Patent No.: US 8,443,919 B2
(45) Date of Patent: May 21, 2013

(54) SEMI-SEALED BLAST HOLE BIT AND METHOD FOR DRILLING

(75) Inventor: Miguel Angel Ramirez Santiago, Carrollton, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 301 days.

(21) Appl. No.: 12/976,789

(22) Filed: Dec. 22, 2010

(65) Prior Publication Data

US 2012/0160561 A1 Jun. 28, 2012

(51) Int. Cl.
*E21B 10/22* (2006.01)

(52) U.S. Cl.
USPC ..... 175/371

(58) Field of Classification Search
USPC ..... 175/337, 371, 372
See application file for complete search history.

(56) References Cited

U.S. PATENT DOCUMENTS

| | | | | | |
|---|---|---|---|---|---|
| 3,102,601 | A * | 9/1963 | Worth | 175/339 |
| 3,788,408 | A * | 1/1974 | Dysart | 175/337 |
| 3,881,560 | A * | 5/1975 | Williams, Jr. | 175/337 |
| 3,990,525 | A * | 11/1976 | Penny | 175/337 |
| 4,178,045 | A | 12/1979 | Neilson | |
| 4,200,343 | A | 4/1980 | Highsmith | |
| 4,209,890 | A | 7/1980 | Koskie, Jr. | |
| 4,249,622 | A | 2/1981 | Dysart | |
| 4,729,440 | A * | 3/1988 | Hall | 175/107 |
| 4,955,440 | A | 9/1990 | Chavez | |
| 4,981,182 | A | 1/1991 | Dysart | |
| 5,027,911 | A | 7/1991 | Dysart | |
| 5,513,715 | A | 5/1996 | Dysart | |
| 6,264,367 | B1 * | 7/2001 | Slaughter et al. | 384/94 |
| 6,330,923 | B1 * | 12/2001 | Wood | 175/371 |
| 6,578,647 | B2 * | 6/2003 | Page et al. | 175/228 |

* cited by examiner

*Primary Examiner* — Kenneth L Thompson
(74) *Attorney, Agent, or Firm* — Gardere Wynne Sewell LLP; Andre M. Szuwalski

(57) ABSTRACT

A drill tool includes a bit body, at least one bearing shaft extending from the bit body, and a cone mounted for rotation on the bearing shaft. A first sealing system includes a first annular seal gland formed in a cylindrical surface of the cone and a seal ring retained within the first annular seal gland and compressed against a cylindrical surface of the bearing shaft. A second sealing system includes a second annular seal gland formed in a radial surface of the cone and a Belleville spring retained within the second annular seal gland and compressed against a radial surface surrounding the bearing shaft. A set of non-pressure compensated lubrication channels are configured to supply lubricant to an interstitial volume defined between the cone and bearing shaft, the lubricant retained within the interstitial volume by the first and second sealing systems, the lubrication channels further supporting open air circulation through the bearing when the sealing systems fail and lubricant is lost.

22 Claims, 4 Drawing Sheets

SEMI-SEALED BLAST HOLE BIT AND METHOD FOR DRILLING

TECHNICAL FIELD

The present invention relates generally to rock bit drilling tools, and more specifically concerns roller cone drilling tools and the bearing system used within such roller cone drilling tools.

BACKGROUND

Reference is made to the following prior art references: Neilson U.S. Pat. No. 4,178,045; Highsmith U.S. Pat. No. 4,200,343; Koskie U.S. Pat. No. 4,209,890; Dysart U.S. Pat. No. 4,249,622; Dysart U.S. Pat. No. 4,981,182; Chavez U.S. Pat. No. 4,955,440; Dysart U.S. Pat. No. 5,027,911; and Dysart U.S. Pat. No. 5,513,715. The disclosures of each of the foregoing references are hereby incorporated by reference.

SUMMARY

In an embodiment, a drill tool comprises: a bit body; at least one bearing shaft extending from the bit body; a cone mounted for rotation on the bearing shaft; a first sealing system comprising a first annular seal gland formed in a cylindrical surface of the cone and a seal ring retained within the first annular seal gland and compressed against a cylindrical surface of the bearing shaft; a second sealing system comprising a second annular seal gland formed in a radial surface of the cone and sealing member (such as, for example, a Belleville spring) retained within the second annular seal gland and compressed against a radial surface surrounding the bearing shaft; and a set of non-pressure compensated lubrication channels configured to supply lubricant to an interstitial volume defined between the cone and bearing shaft, the lubricant retained within the interstitial volume by the first and second sealing systems, the lubrication channels further supporting open air circulation through the bearing when the sealing systems fail and lubricant is lost.

In another embodiment, a method for rock drilling comprises: providing a non-pressure compensated rock drill bit with a bearing sealed to contain lubricant; using the rock drill bit in an initial drilling mode with the lubricant supporting bearing operation; continuing the initial drilling mode until seal failure and loss of the bearing lubricant; and further using the rock drill bit in a secondary drilling mode, after loss of bearing lubricant, with an open air circulation supporting bearing operation.

DETAILED DESCRIPTION OF THE DRAWINGS

Figure 1:
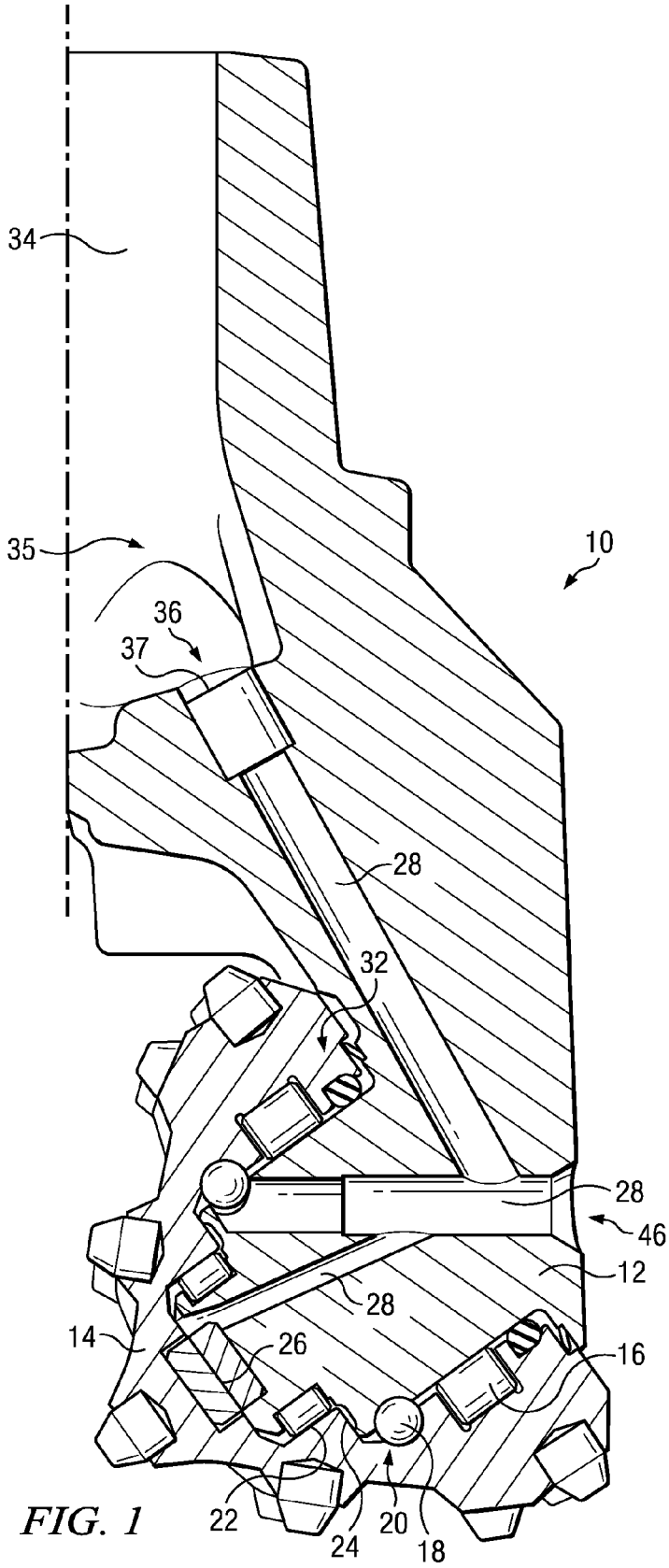
FIG. 1 illustrates a cross-sectional view of a portion of a roller cone rock bit.

Reference is now made to FIG. 1 which illustrates a cross-sectional view of a portion of a roller cone rock bit. FIG. 1 specifically illustrates the portion comprising one head and cone assembly of the bit. The general configuration and operation of such a bit is well known to those skilled in the art.

The head 10 of the bit includes a downwardly and inwardly extending bearing shaft 12. A cutting cone 14 is rotatably mounted on the bearing shaft 12. The bearing system for the head and cone assembly that is used in roller cone rock bits to rotatably support the cone 14 on the bearing shaft 12 typically employs either rollers as the load carrying element (a roller bearing system) or a journal as the load carrying element (a friction bearing system). FIG. 1 specifically illustrates a roller bearing implementation including a bearing system defined by a first roller bearing 16 (also referred to as the main roller bearing). The cone 14 is axially retained on the bearing shaft 12, and further supported for rotation, by a set of ball bearings 18 that ride in the annular raceway 20 defined at an interface between the bearing shaft 12 and cone 14. The ball bearings 18 are delivered to the raceway 20 through a ball opening 46, with that opening 46 being closed by a ball plug (not explicitly shown). The bearing system for the head and cone assembly further includes a second roller bearing 22, a first radial friction (thrust) bearing 24 and a second radial friction (thrust) bearing 26. A body portion 34 of the bit, from which the head and cone assembly depends, includes an upper threaded portion forming a tool joint connection which facilitates connection of the bit to a drill string (not shown, but well understood by those skilled in the art).

The bearing system for the head and cone assembly of the bit is lubricated and sealed from the external environment by the annular seals. An interstitial volume within the bearing system is defined between the cone 14 and the bearing shaft 12, and this volume is filled with a lubricant (typically, grease). The lubricant is provided to the interstitial volume through a series of lubricant channels 28. The illustrated bit is of the type which does not include a pressure compensator coupled in fluid communication with the series of lubricant channels 28. Thus, an upper end 36 of the lubricant channel 28 is open, or alternatively is temporarily sealed at a location adjacent an inner air flow chamber 35. The temporary seal may take the form of any suitable isolation structure 37 such as, for example, a check valve, a one-way valve, a one-way membrane, or the like. The lubricant is retained within the bearing system in the region of the cones by a sealing system 32 provided between the base of the cone 14 and the base of the bearing shaft 12.

The first roller bearing (main roller bearing) 16 is defined by an outer cylindrical surface on the bearing shaft 12 and a set of roller bearings provided within an annular roller raceway in the cone 14. The second roller bearing 22 is defined by an inner cylindrical surface on the cone 14 and a set of roller bearings provided within an annular roller raceway in the shaft 12. The first radial friction (thrust) bearing 24 of the bearing system is defined between the first and second roller bearings 16 and 22 by a first radial surface on the bearing shaft 12 and a second radial surface on the cone 14. The second radial friction (thrust) bearing 26 of the bearing system is adjacent the second roller bearing 22 at the axis of rotation for the cone and is defined by a third radial surface on the bearing shaft 12 and a fourth radial surface on the cone 14.

Figure 2:
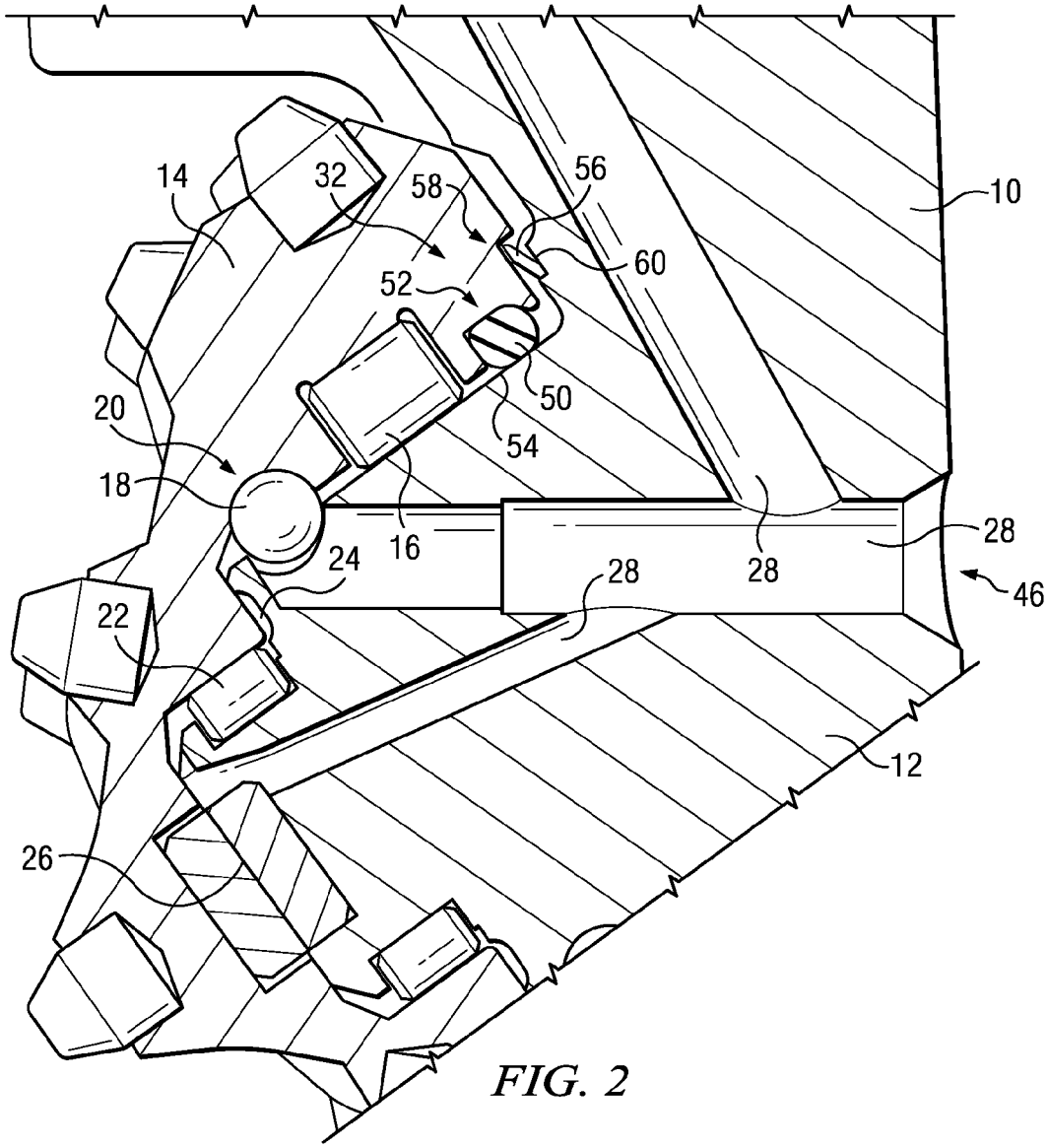
FIGS. 2 and 3 illustrate cross-sectional views of the bit shown in FIG. 1 focusing on a bearing shaft and cone in greater detail around the location of the sealing system.
Figure 3:
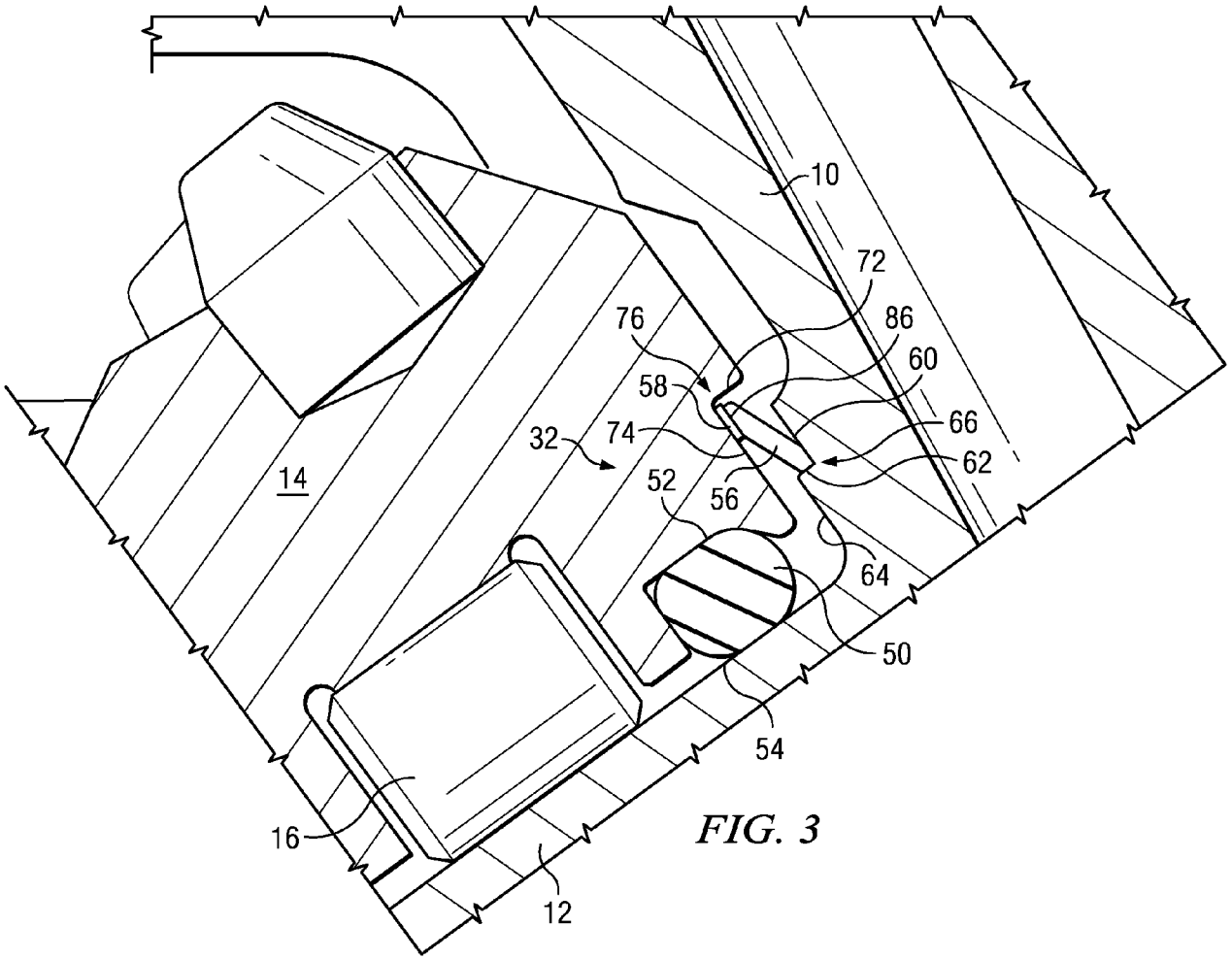
Figure 5:
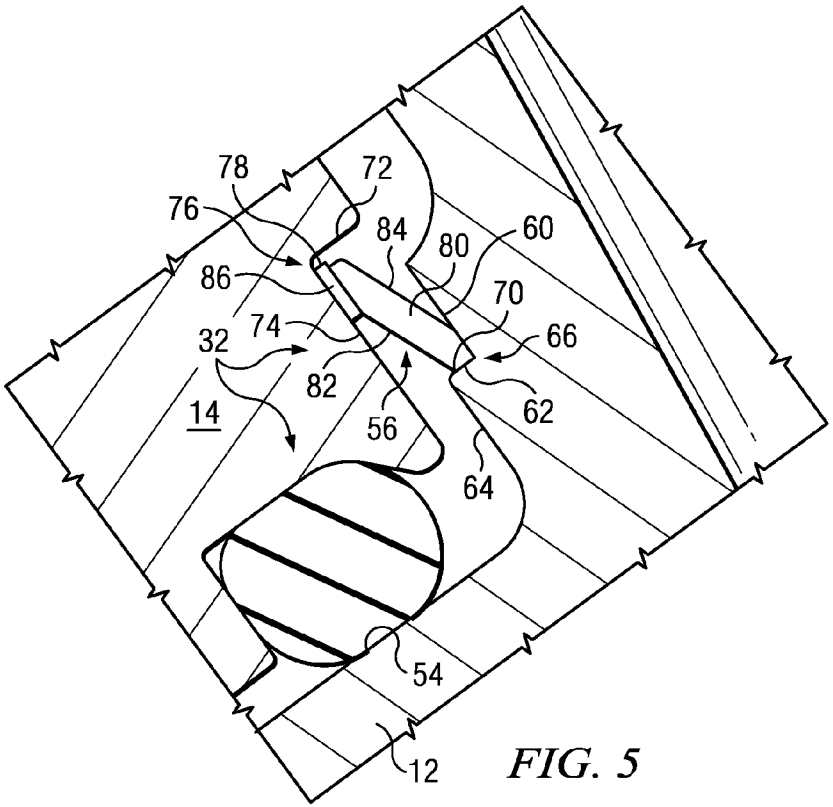
FIG. 5 illustrates a cross-sectional view of the bit shown in FIG. 1 focusing on the sealing system.

Reference is now made to FIGS. 2 and 3 which illustrate cross-sectional views of the bit shown in FIG. 1 focusing on a bearing shaft and cone in greater detail around the location of the sealing system, and FIG. 5 which illustrates a cross-sectional view of the bit shown in FIG. 1 focusing on the sealing system. The sealing system 32 comprises an o-ring type seal member 50 positioned in a seal gland 52 between the cutter cone 14 and the bearing shaft 12 to retain lubricant and exclude external debris. A cylindrical sealing surface 54 is provided at the base of the bearing shaft 12. The annular seal gland 52 is formed in a cylindrical surface at the base of the cone 14. The gland 52 and sealing surface 54 align with each other when the cutting cone 14 is rotatably positioned on the bearing shaft 12. The o-ring sealing member 50 is compressed between the surface(s) of the gland 52 and the sealing surface 54, and functions to retain lubricant within the bearing system. This sealing member 50 also prevents materials in the well bore (such as drilling debris) from entering into the bearing system.

Lubricant (such as grease) is provided in the interstitial volume that is defined between the cone and shaft at the first roller bearing 16, the second roller bearing 22, the ball bearings 18, the surfaces of the first radial friction bearing 24 and the surfaces of the second radial friction bearing 26. The sealing system 32 with the o-ring type seal member 50 positioned in the seal gland 52 functions to retain the lubricant within the lubrication system and specifically between the opposed surfaces of the bearing system.

The sealing system 32 further comprises an additional sealing member 56. In one embodiment, the additional sealing member 56 is a Belleville ring type seal member positioned in a seal gland 58 between the cutter cone 14 and the bearing shaft 12 to retain lubricant and exclude external debris. A radial sealing surface 60 is provided on the head circumferentially surrounding the base of the bearing shaft 12. The annular seal gland 58 is formed including a radial sealing surface 74 at the base of the cone 14. The gland 58 and sealing surface 60 align with each other when the cutting cone 14 is rotatably positioned on the bearing shaft 12. The Belleville ring type seal member is compressed between the surface(s) of the gland 58 and the sealing surface 60, and functions to retain lubricant within the bearing system. The sealing member 56 also prevents materials in the well bore (such as drilling debris) from entering into the bearing system.

A cylindrical sealing surface 62 is provided on the head 10 adjacent the radial sealing surface 60. The surfaces 60 and 62 circumferentially surround the base of the bearing shaft 12, and in a preferred implementation are offset from the base of the bearing shaft by a radial surface 64. A corner 66 is provided by the intersection of the surfaces 60 and 62. The cylindrical sealing surface 62 has a diameter substantially equal to an inner diameter of the sealing member 56 (for example, the Belleville ring type seal member) such that the inner circumferential surface 70 (see, FIG. 4) of the sealing member (Belleville ring type seal member) rests adjacent the cylindrical sealing surface 62 and is positioned in the corner 66.

A cylindrical surface 72 is provided on the cone 14 adjacent the radial sealing surface 74. A corner 76 is provided by the intersection of the surfaces 72 and 74. The cylindrical surface 72 has a diameter larger than an outer diameter of the sealing member 56 (Belleville ring type seal member). As the sealing member (Belleville ring type seal member) 56 is compressed, this permits movement of the seal member 56 along the radial sealing surface 74 until the outer circumferential surface 78 (see, FIG. 4) of the sealing member 56 ring rests adjacent the cylindrical surface 72 and is positioned in the corner 76.

Figure 4:
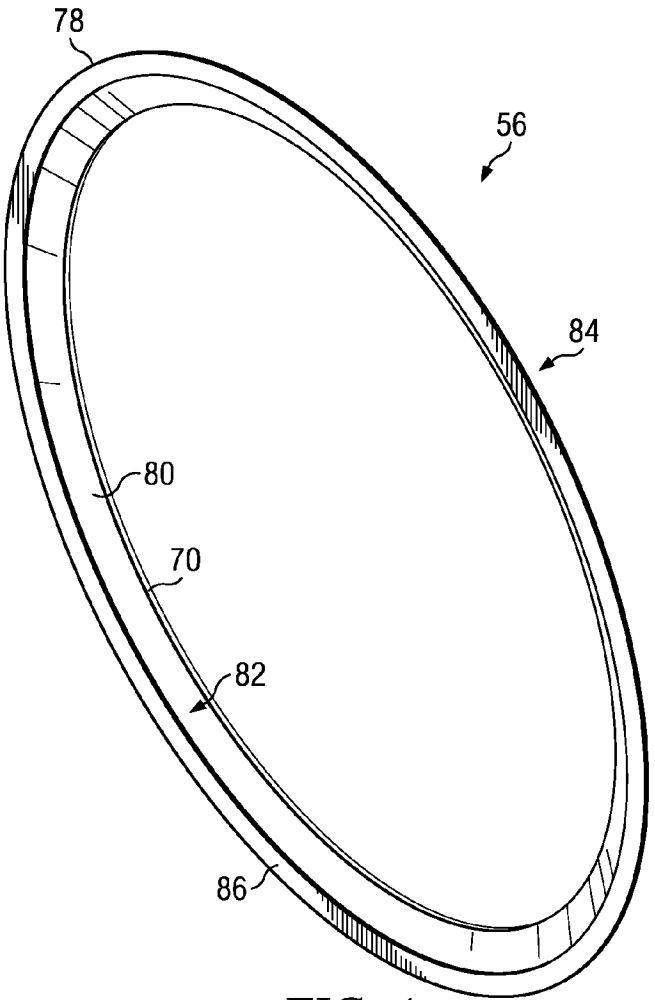
FIG. 4 illustrates a perspective view of a Belleville ring type seal member.

Reference is now made to FIG. 4 which illustrates a perspective view of the Belleville ring type seal member 56. The Belleville ring type seal member 56 includes a metal spring 80 having a conical shape. The ring 80 has an inner circumferential surface 70 and an outer circumferential surface 78. The conical shape defines a first surface 82 (on the inside of the conical shape) and a second surface 84 (on the outside of the conical shape). A sealing material 86 is attached to the outer periphery of the first surface 82 extending out to the outer circumferential surface 78. In a preferred implementation, this sealing material 86 is polytetrafluoroethylene (PTFE) and is provided by a PTFE ring surface mounted by an adhesive or other attachment means to the first surface 82 of the metal spring 80. In other embodiments, the sealing material 86 may be leather, packing foam, silicone, rubber, wire mesh, wax, clay, or other materials known in the art, including various elastomers such as, for example, nitrile buna rubber (NBR), highly saturated nitrile buna rubber (HNBR), fluoroelastomers (FKM), and perfluoroelastomers (FFKM). In these other embodiments, the sealing material 86 is provided by a ring surface comprised of any of the foregoing materials, wherein the ring surface is mounted by an adhesive or other attachment means to the first surface 82 of the metal spring 80.

The roller cone rock bit has a preferred use as a mining bit, for example in the preparation of blast holes. The bit has a sealed bearing but because it is not used at great drill depths there is no need for a pressure compensation system. The bit utilizes two independent seals in the area of the base of each bearing shaft. The first seal is provided by the o-ring or other elastomeric seal and the second seal is provided by the Belleville ring. In an alternative embodiment, the sealing member 56 may comprise another ring shaped sealing structure such as a fine mesh screen, having for example a shape similar to that of the Belleville spring, capable of limiting the influx of fine drilling particles into the area of the elastomeric seal. The o-ring primarily functions to retain grease (and may additionally function to keep debris from reaching the bearing). The Belleville ring or alternative mesh ring structure primarily functions to keep debris (such as dust particles) from reaching the o-ring (and may additionally function to retain grease).

A preferred operation of the bit is as follows. During an initial drilling mode, the bit utilizes a lubricated bearing supported by operation of the o-ring seal and the Belleville ring seal. After a period of time drilling in this initial mode, the seals will fail and the grease within the bearing will be evacuated. Operation of the bit then moves to a secondary drilling mode where the bit utilizes an open air circulation bearing. Open air circulation is supported because there is no pressure compensation system included on the bit to block fluid (air) circulation through the lubricant channels 28 and to the bearing. After a period of time drilling in this secondary mode, the roller bearings will fail. The bit will then need to be replaced, and may be repaired by replacing the roller/friction bearings and recharging the lubrication system. However, the air circulation in the secondary drilling mode provides for an extended operating use of the bit after seal failure.

An alternative embodiment additionally uses the isolation structure 37 (providing a barrier such as a breakable membrane, a breakable plug, or a one way valve) deployed at or near the upper end of lubricant channel 28 in the region 36. The purpose of this isolation structure 37 is to limit the erosion or premature displacement of the lubricant or grease column prior to the failure of the primary seals. The isolation structure 37 may be fixed in place through the use of adhesive, press fit, threads, snap rings, or other methods known in the art. This isolation structure 37 acts to isolate the air flow through the inner air flow chamber 35 of the bit from the lubricant or grease volume within channel 28 while the annular cone seals are effective. When the annular seals fail, pressure from the air flow within inner air flow chamber 35 overcomes the resistance of the isolation structure 37 to allow air flow to incept or accelerate the evacuation of grease or lubricant from the bearing system, thus ultimately converting the bearing system from grease lubrication to air lubrication (through open air circulation).

It should be noted that each of the three bearings on a leg of the bit act independently and that the failure of one primary set of seals and the conversion of that bearing on one leg to an air lubricated bearing may precede in time the failure of one or both of the other bearings on other legs of the bit.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A drill tool, comprising:

a bit body;

at least one bearing shaft extending from the bit body;

a cone mounted for rotation on the bearing shaft;

a first sealing system comprising a first annular seal gland formed in a cylindrical surface of the cone and a seal ring retained within the first annular seal gland and compressed against a cylindrical surface of the bearing shaft;

a second sealing system comprising a second annular seal gland formed in a radial surface of the cone and a sealing structure retained within the second annular seal gland and compressed against a radial surface surrounding the bearing shaft; and a set of non-pressure compensated lubrication channels configured to supply lubricant to an interstitial volume defined between the cone and bearing shaft, the lubricant retained within the interstitial volume by the first and second sealing systems, the lubrication channels further supporting open air circulation through the bearing when the sealing systems fail and lubricant is lost.

2. The tool of claim 1, wherein the sealing structure of the second sealing system comprises a Belleville spring.

3. The tool of claim 2, wherein the second sealing system comprises a first corner formed between the radial surface surrounding the bearing shaft and a first cylindrical surface, wherein an inner circumferential surface of the Belleville spring is positioned at the first corner.

4. The tool of claim 3, wherein the first cylindrical surface is offset from the bearing shaft by an offset radial surface surrounding the bearing shaft.

5. The tool of claim 3, wherein the second sealing system further comprises a second corner formed between the radial surface of the cone and a second cylindrical surface, wherein an outer circumferential surface of the Belleville spring is positioned near the second corner.

6. The tool of claim 5, wherein compression of the Belleville spring causes movement of the outer circumferential surface of the Belleville spring towards the second corner.

7. The tool of claim 2, wherein the Belleville spring comprises a sealing material attached to an outer periphery of a surface of the Belleville spring, the sealing material extending out to the outer circumferential surface.

8. The tool of claim 7, wherein the sealing material is in contact with the radial surface of the cone.

9. The tool of claim 7, wherein the sealing material comprises a polytetrafluoroethylene ring mounted to the outer periphery of the surface of the Belleville spring.

10. The tool of claim 7, wherein the sealing material comprises a ring mounted to the outer periphery of the surface of the Belleville spring, the ring comprising a material selected from the group comprising leather, packing foam, silicone, rubber, wire mesh, wax, clay, nitrile buna rubber, highly saturated nitrile buna rubber, fluoroelastomers, and perfluoroelastomers.

11. The tool of claim 1, wherein the sealing structure of the second sealing system comprises a mesh screen ring.

12. The tool of claim 11, wherein the second sealing system comprises a first corner formed between the radial surface surrounding the bearing shaft and a first cylindrical surface, wherein an inner circumferential surface of the mesh screen ring is positioned at the first corner.

13. The tool of claim 12, wherein the first cylindrical surface is offset from the bearing shaft by an offset radial surface surrounding the bearing shaft.

14. The tool of claim 12, wherein the second sealing system further comprises a second corner formed between the radial surface of the cone and a second cylindrical surface, wherein an outer circumferential surface of the mesh screen ring is positioned near the second corner.

15. The tool of claim 1, further comprising a one-way fluid passage isolation structure mounted in one of the non-pressure compensated lubrication channels between an interior of the lubrication channel and an exterior air region of the tool.

16. The tool of claim 15, wherein the isolation structure permits fluid flow into the interior of the lubrication channel from an inner air flow chamber of the tool.

17. The tool of claim 16, wherein the isolation structure permits injection of lubricant into the set of non-pressure compensated lubrication channels to deliver lubricant to the interstitial volume defined between the cone and bearing shaft.

18. The tool of claim 16, wherein the isolation structure permits, following failure of at least the first sealing system to retain lubricant within the interstitial volume, air to enter into the set of non-pressure compensated lubrication channels from the inner air flow chamber of the tool.

19. The tool of claim 18, wherein the entering air assists in evacuating lubricant from within the interstitial volume.

20. The tool of claim 18, wherein the entering air supports the open air circulation through the bearing when the sealing systems fail and lubricant is lost.

21. A method for rock drilling, comprising:

providing a non-pressure compensated rock drill bit with a bearing sealed to contain lubricant;

using the rock drill bit in an initial drilling mode with the lubricant supporting bearing operation;

continuing the initial drilling mode until seal failure and loss of the bearing lubricant; and further using the rock drill bit in a secondary drilling mode, after loss of bearing lubricant, with an open air circulation supporting bearing operation; and wherein providing comprises providing a first o-ring type sealing system and providing a second Belleville spring type sealing system to seal the bearing and contain lubricant.

22. The method of claim 21, wherein lubricant is supplied to the bearing through lubricant channels, and where the lubricant channels support open air circulation during the secondary drilling mode.

* * * * *